US005551095A

United States Patent [19]

Chen

[11] Patent Number: 5,551,095

[45] Date of Patent: Sep. 3, 1996

[54] LIQUID RELEASING DEVICE WITH AN ADJUSTABLE MOUNTING UNIT FOR MOUNTING ON A RIM OF A WATER TANK

[76] Inventor: Sung-Tzu Chen, No. 2, Kuang-I-Heng Lane, Su-Ao-Chen, I-Lan Hsien, Taiwan

[21] Appl. No.: 396,609

[22] Filed: Mar. 1, 1995

[51] Int. Cl.[6] ..... E03D 9/02

[52] U.S. Cl. ..... 4/227.3; 4/227.1; 248/215

[58] Field of Search ..... 4/227.1–227.7, 4/231; 248/214, 215

[56] References Cited

U.S. PATENT DOCUMENTS

| | | | |
|---|---|---|---|
| 3,627,177 | 12/1971 | Marcus et al. . | |
| 4,059,248 | 11/1977 | Kuntz | 248/214 |
| 4,247,070 | 1/1981 | Dirksing | 4/227.1 X |
| 4,436,269 | 3/1984 | Dirksing et al. | 4/227.1 X |

*Primary Examiner*—Robert M. Fetsuga
*Attorney, Agent, or Firm*—Foley & Lardner

[57] ABSTRACT

A liquid releasing device for a water tank includes a container disposed in the water tank for receiving liquid therein, a float-controlled valve assembly mounted on a bottom wall of the container for releasing the liquid in the container when water level in the water tank drops below a predetermined level, and an adjustable mounting unit for mounting the container on a rim of the water tank. The mounting unit includes an elongated first support member mounted slidably on a top surface of the container, and an elongated second support member mounted slidably and longitudinally to the first support member. The second support member has one end portion formed with a hook portion, and another end portion connected slidably to the first support member. The first support member has a distal end adjacent to the hook portion. The hook portion is movable relative to the distal end of the first support member so as to define a variable holding space with the distal end of the first support member for engaging the rim of the water tank. The first support member is movable relative to the container to permit maintaining of the container at an upright position so as to ensure proper operation of the float-controlled valve assembly.

3 Claims, 7 Drawing Sheets

LIQUID RELEASING DEVICE WITH AN ADJUSTABLE MOUNTING UNIT FOR MOUNTING ON A RIM OF A WATER TANK

BACKGROUND OF THE INVENTION

1. Field of the Invention

This invention relates to a liquid releasing device, more particularly to a liquid releasing device which has an adjustable mounting unit for mounting adjustably a container of the liquid releasing device on a rim of a water tank so as to permit maintaining of the container at an upright position, thereby ensuring proper operation of a float-controlled valve assembly of the liquid releasing device.

2. Description of the Related Art

The improvement of this invention is directed to a conventional liquid releasing device for a water tank.

Referring to FIG. 1, the conventional liquid releasing device 1 includes a container 10 which is disposed in the water tank 20, such as a toilet tank, and which receives liquid therein. This liquid may be a disinfectant or a cleaning liquid. The container 10 has an outlet portion formed in a bottom surface thereof. A mounting unit includes several hook elements 11 which are secured to upper portions of side walls of the container 10 and which engage the rim of the water tank 20 so as to position the container 10 on the rim of the water tank 20. A float-controlled valve assembly consists of a valve unit 13 mounted to the outlet portion of the container 10 for closing or opening the outlet portion, and a float ball unit 12 connected to and located beneath the valve unit 13 for actuating the valve unit 13.

When water level in the water tank 20 drops below the float ball unit 12, the float ball unit 12 moves downwardly by virtue of the weight of the float-controlled valve assembly so as to actuate the valve unit 13 and open the outlet portion of the container 10 in a known manner. Thus, the liquid in the container 10 can be released into the water tank 20 via the outlet portion of the container 10. When the water level in the water tank 20 raises above the float ball unit 12, the float ball unit 12 can be moved upwardly by virtue of a buoyant force applied by the water in the water tank 20 so as to actuate the valve unit 13 and close the outlet portion of the container 10.

It is noted that the container 10 has to be maintained at an upright position so as to ensure proper upward or downward movement of the float ball unit 12. Accordingly, the vertical movement of the float ball unit 12 can actuate effectively the valve unit 13 to close or open precisely the outlet portion of the container 10.

However, if the water tank 20 has an inclined or curved side wall 21, as shown in FIG. 2, the container 10 cannot be maintained at an upright position when mounted on the rim of the water tank 20. In this case, the direction along which the float ball unit 12 is moved by virtue of the buoyant force inclines relative to the direction along which the float ball unit 12 pushes the valve unit 13. In this way, the valve unit 13 cannot close precisely the outlet portion of the container 10. This may cause leakage of the liquid in the container 10 via the outlet portion of the container 10.

SUMMARY OF THE INVENTION

Therefore, the main objective of the present invention is to provide a liquid releasing device which utilizes an adjustable mounting unit to mount adjustably a container of the liquid releasing device on a rim of a water tank so as to permit maintaining of the container at an upright position, thereby ensuring proper operation of a float-controlled valve assembly of the liquid releasing device to close precisely an outlet portion of the container.

According to this invention, a liquid releasing device is used for a water tank and includes a container which is to be disposed in the water tank and which receives liquid therein, a float-controlled valve assembly which is mounted on a bottom wall of the container for releasing the liquid in the container when water level in the water tank drops below a predetermined level, and an adjustable mounting unit for mounting the container on a rim of the water tank.

The mounting unit includes an elongated first support member mounted slidably on a top surface of the container, and an elongated second support member mounted slidably and longitudinally to the first support member. The second support member has one end portion formed with a hook portion, and another end portion connected slidably to the first support member. The first support member has a distal end adjacent to the hook portion of the second support member. The hook portion of the second support member is movable relative to the distal end of the first support member so as to define a variable holding space with the distal end of the first support member for engaging the rim of the water tank. The first support member is movable relative to the container to permit maintaining of the container at an upright position so as to ensure proper operation of the float-controlled valve assembly.

The first support member includes a sleeve member which has two opposite side walls, a base wall interconnecting the side walls for confining a guiding groove among the base and side walls, and two aligned resilient retaining tongues mounted respectively to inner faces of the side walls. The another end portion of the second support member is formed with an elongated slide piece which is received fittingly and slidably within the guiding groove of the sleeve member and which has two opposite side surfaces formed respectively with a plurality of teeth that are engageable with the retaining tongues of the sleeve member so as to position adjustably the slide piece in the guiding groove.

Preferably, the container has a dovetail groove which is formed in the top surface thereof and which opens in two opposite side surfaces of the container, and two aligned retaining lugs which are secured respectively to two opposite inner side walls that confine the dovetail groove. The sleeve member is received slidably and fittingly within the dovetail groove and has a plurality of teeth formed on outer faces of the side walls thereof. The retaining lugs are engageable with the teeth of the sleeve member so as to position adjustably the sleeve member in the dovetail groove.

BRIEF DESCRIPTION OF THE DRAWINGS

Other features and advantages of this present invention will become apparent in the following detailed description of a preferred embodiment of this invention, with reference to the accompanying drawings, in which.

DETAILED DESCRIPTION OF THE PREFERRED EMBODIMENT

Figure 1:
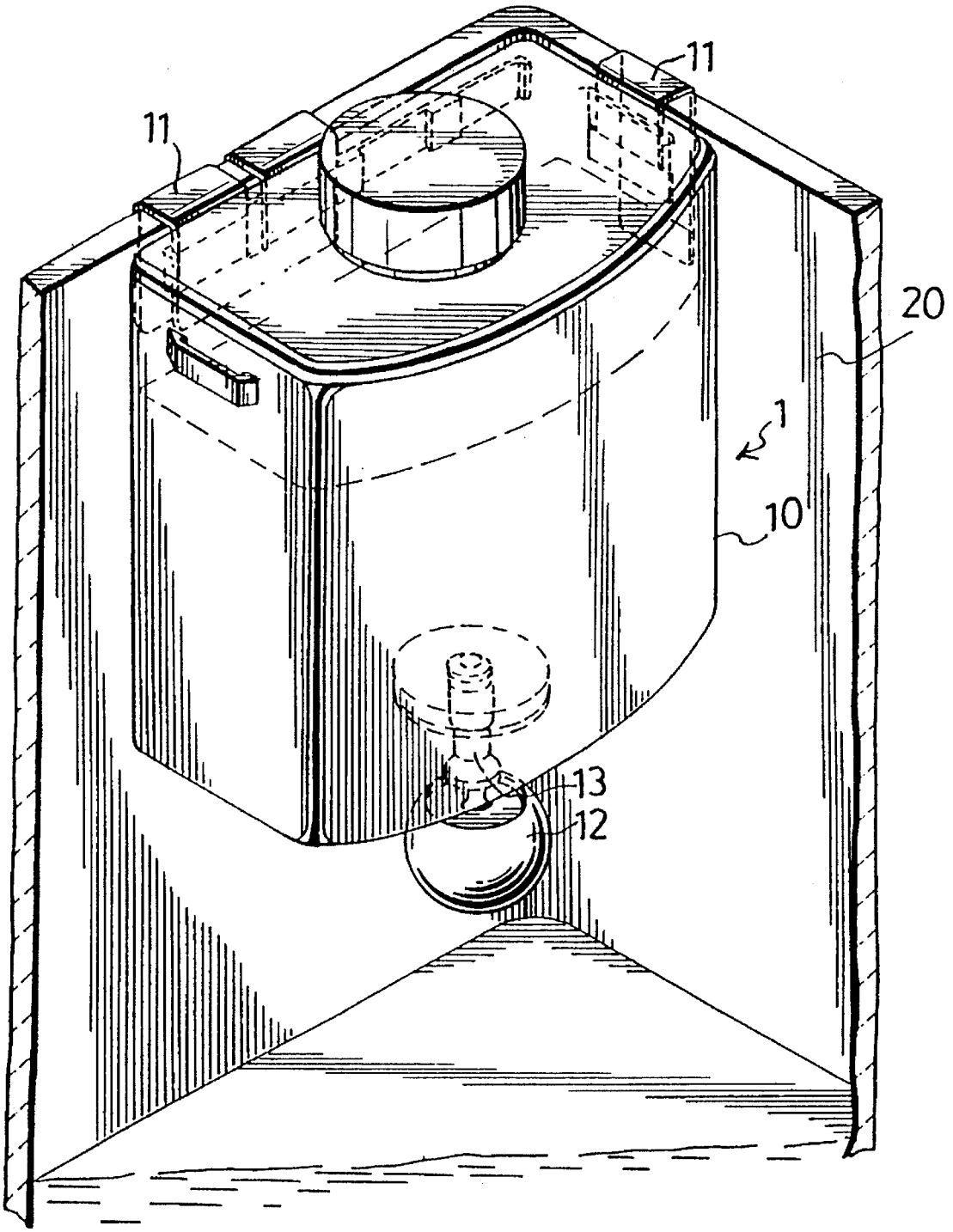
FIG. 1 PRIOR ART
FIG. 1 is a schematic view illustrating how a conventional liquid releasing device is installed in a water tank.
Figure 2:
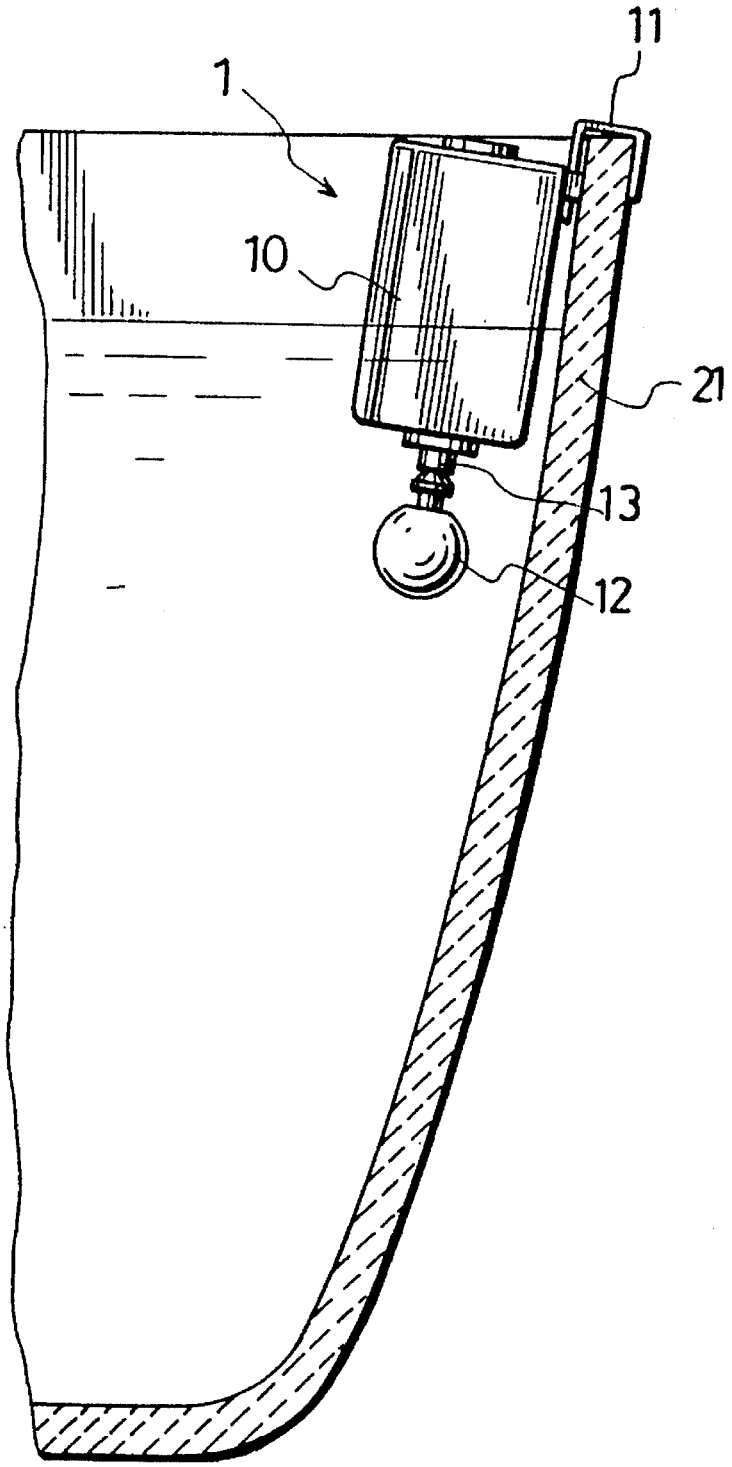
FIG. 2 PRIOR ART
FIG. 2 is a schematic view illustrating mounting of the conventional liquid releasing device on an oblique side wall of the water tank.
Figure 3:
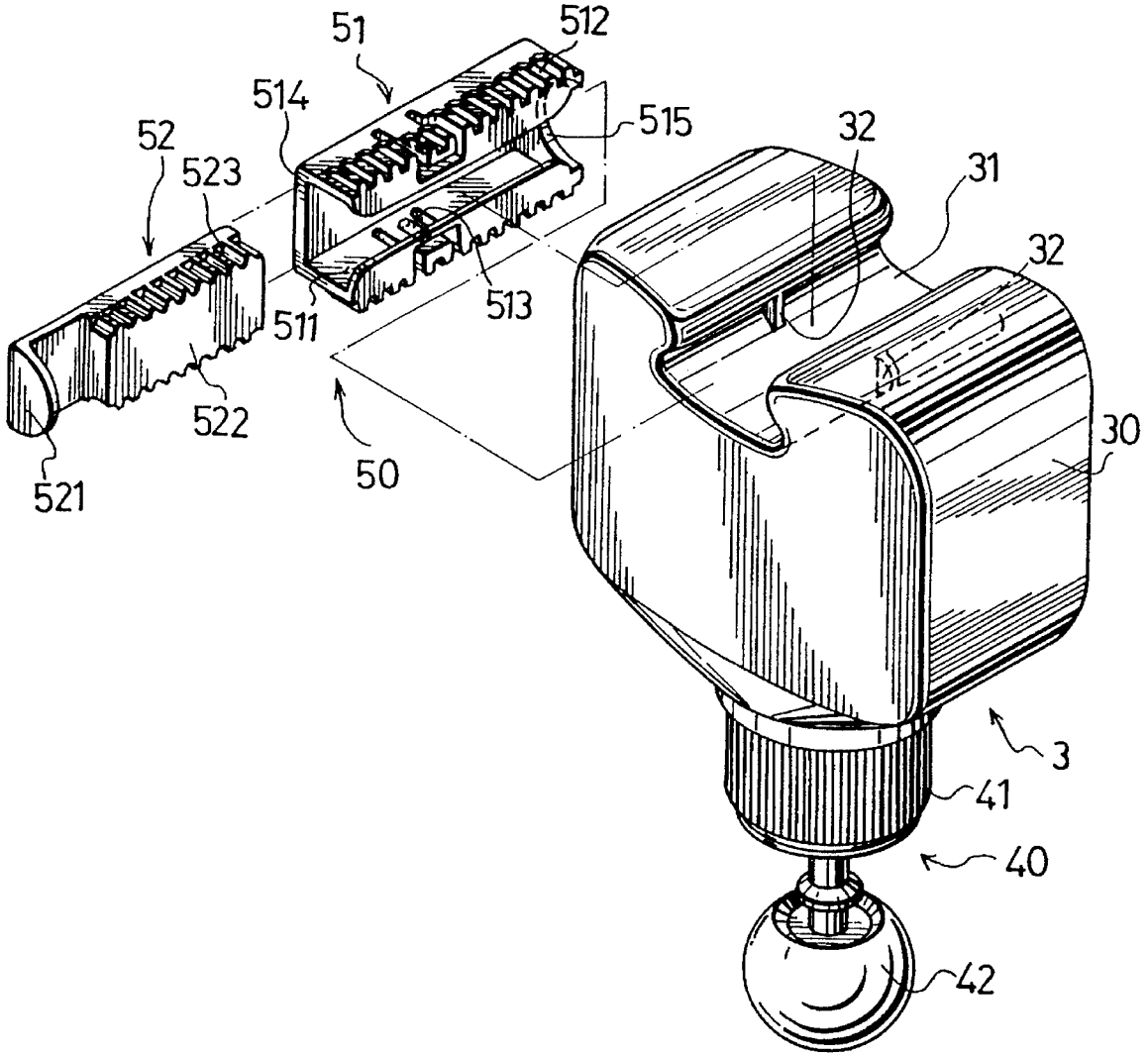
FIG. 3 is an exploded view showing a liquid releasing device according to the preferred embodiment of this invention.
Figure 7:
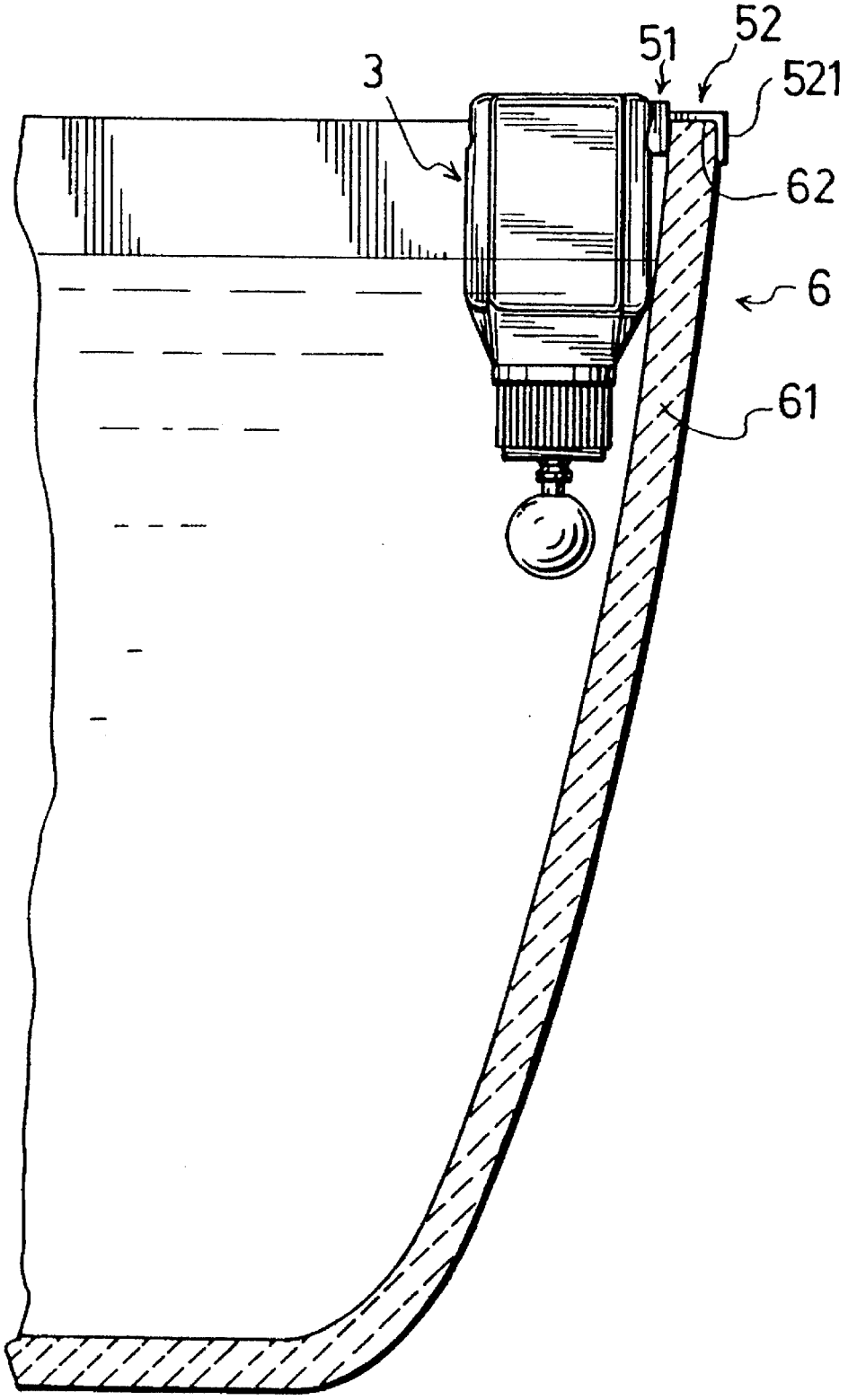
FIG. 7 is a schematic view illustrating how the liquid releasing device is maintained at an upright position during use in accordance with this invention.

Referring to FIGS. 3 and 7, the preferred embodiment of a liquid releasing device 3 according to this invention is installed in a water tank 6 (see FIG. 7), and includes a container 30, a float-controlled valve assembly 40 which consists of a valve unit 41 and a float ball unit 42, and an adjustable mounting unit 50 which consists of an elongated first support member 51 and an elongated second support member 52.

The container 30 is disposed in the water tank 6 and receives a liquid therein, such as a disinfectant or a cleaning liquid. The container 30 has an outlet portion (not shown) formed in a bottom surface thereof for permitting release of the liquid in the container 30 into the water tank 6, a dovetail groove 31 which is formed in a top surface of the container 30 and which opens in two opposite side surfaces of the container 30, and two aligned retaining lugs 32 which are mounted respectively and securely to two opposite inner side walls that confine the dovetail groove 31.

The valve unit 41 is mounted actuatably to the outlet portion of the container 30 in a known manner for opening or closing the outlet portion. The float ball unit 42 is connected to and is located beneath the valve unit 41 for actuating the valve unit 41 in a known manner to open or close the outlet portion of the container 30 when water lever in the water tank 6 drops below or rises above the float ball unit 42.

Figure 4:
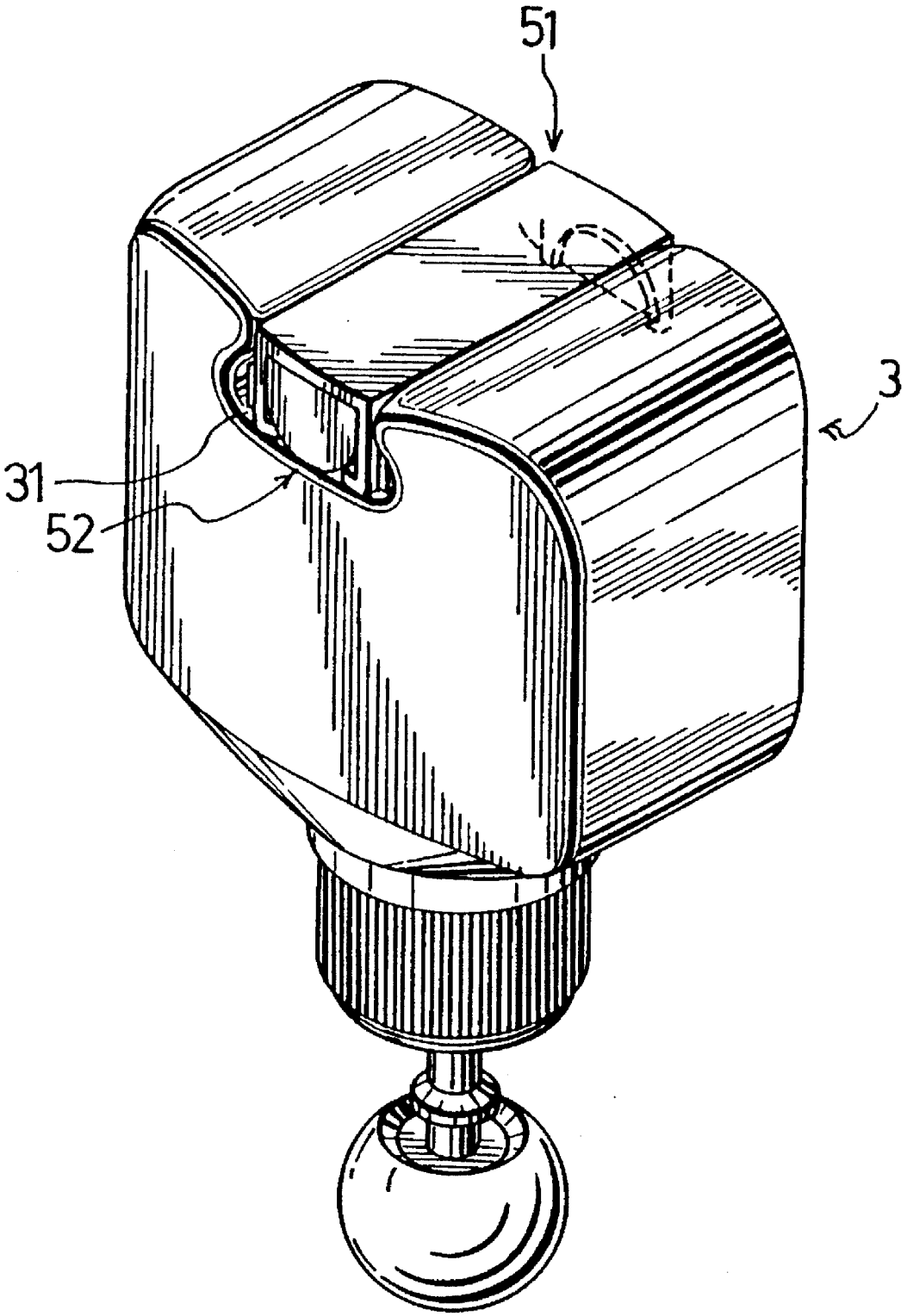
FIGS. 4 and 5 are perspective views showing the assembly of the liquid releasing device according to this invention.

Referring to FIGS. 3 and 4, the first support member 51 includes a sleeve member which has two opposite side walls, and a base wall which interconnects the side walls to confine a guiding groove 511 among the base and side walls. The sleeve member is received slidably and fittingly within the dovetail groove 31 of the container 30. A plurality of teeth 512 are formed on outer faces of the side walls of the sleeve member. Two aligned resilient retaining tongues 513 are mounted respectively to inner faces of the side walls of the sleeve member.

Figure 5:
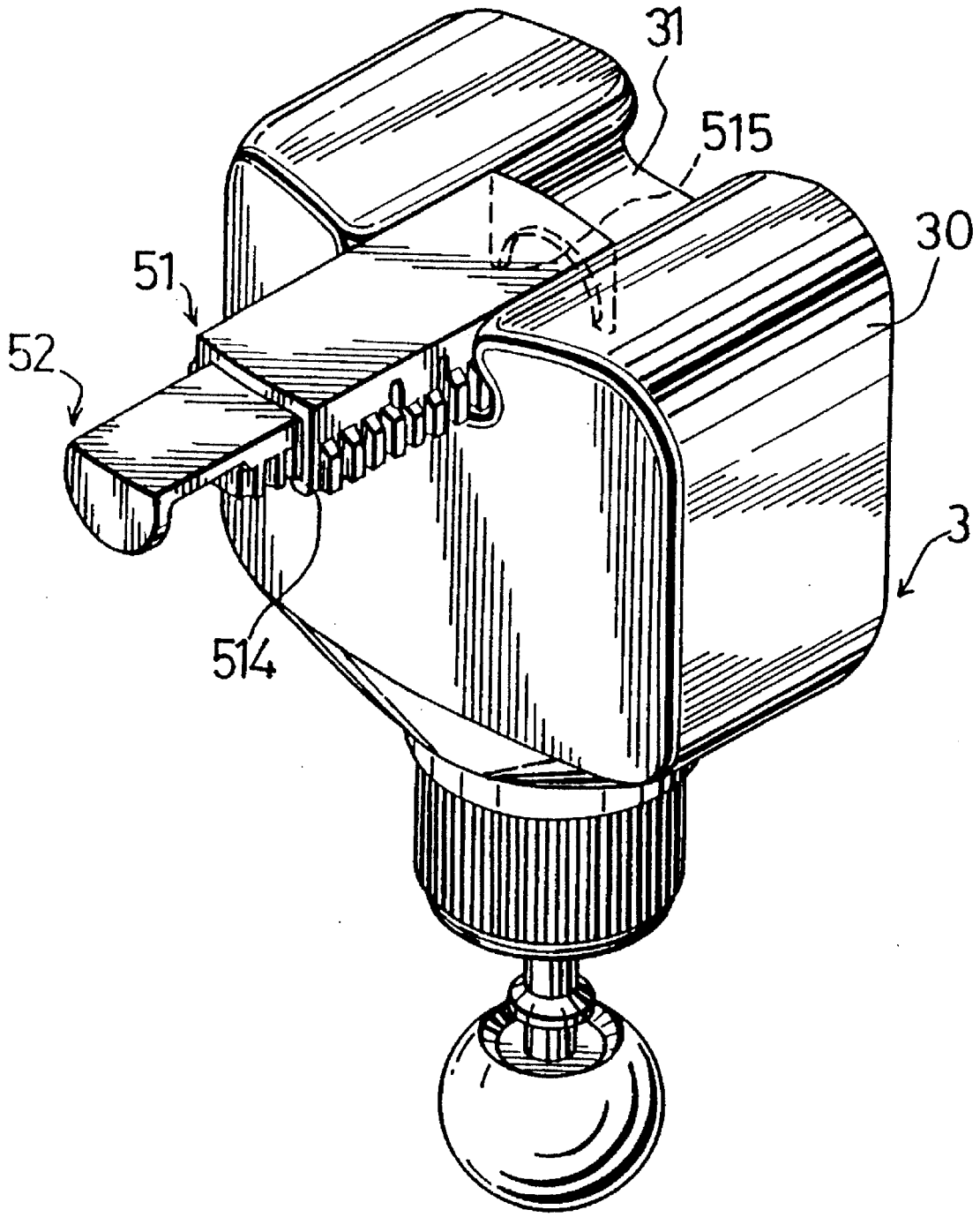

The retaining lugs 32 of the container 30 are engageable with the teeth 512 of the sleeve member so as to position adjustably the sleeve member in the dovetail groove 31 of the container 30. The sleeve member has a distal end 514, and another end formed with an inwardly projecting curved flange 515 that enables the user to push conveniently the sleeve member along the dovetail groove 31 to a predetermined position, as shown in FIG. 5.

Referring again to FIGS. 3, 4 and 5, the second support member 52 can be inserted slidably and longitudinally into the guiding groove 511 of the sleeve member. One end portion of the second support member 52 is formed with a hook portion 521, while another end portion of the second support member 52 is formed with an elongated slide piece 522 which is received fittingly and slidably within the guiding groove 511 of the sleeve member. The slide piece 522 has two opposite side surfaces formed respectively with teeth 523 that are engageable with the retaining tongues 513 of the sleeve member so as to position adjustably the slide piece 522 in the guiding groove 511.

Figure 6:
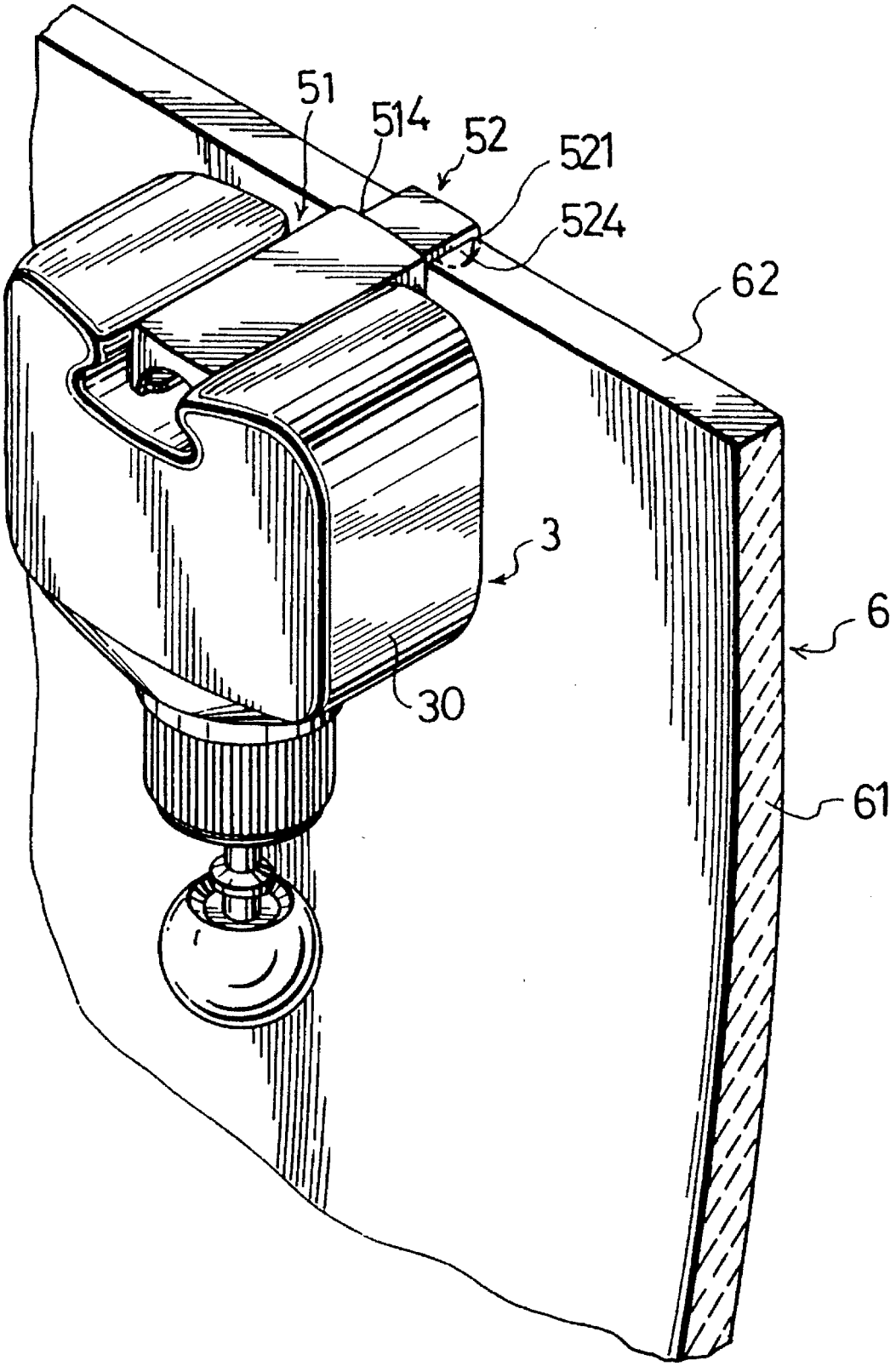
FIG. 6 is a perspective view illustrating how the liquid releasing device is mounted to a rim of a water tank in accordance with this invention.

Referring to FIGS. 3 and 6, when it is desired to mount the container 30 to a side wall 61 of the water tank 6, the distal end 514 of the sleeve member has to be moved outwardly of the dovetail groove 31 of the container 30 toward the side wall 61 of the water tank 6. Then, the slide piece 522 of the second support member 52 is moved along the guiding groove 511 of the sleeve member toward the side wall 61 until the hook portion 521 of the second support member 52 and the distal end 514 of the sleeve member together define a variable holding space 524 that engage fittingly a rim 62 of the water tank 6. Thus, the container 30 of the liquid releasing device 3 can be supported on the rim 62 of the water tank 6.

Referring again to FIGS. 6 and 7, since the container 30 is movable relative to the first support member 51, when the liquid releasing device 3 is mounted to an inclined side wall 61 of the water tank 6, the container 30 can still be maintained at an upright position by moving an upper end of the container 30 slightly away from the rim 62 of the water tank 6 and then placing a lower end of the container 30 against an inner face of the side wall 61 of the water tank 6. In this way, proper operation of the float-controlled valve assembly 40 can be ensured.

While the present invention has been described in connection with what is considered the most practical and preferred embodiment, it is understood that this invention is not limited to the disclosed embodiment but is intended to,cover various arrangements included within the spirit and scope of the broadest interpretations and equivalent arrangement.

I claim:

1. A liquid releasing device for a water tank, including a container which is to be disposed in said water tank and which receives liquid therein, a float-controlled valve assembly mounted on a bottom wall of said container for releasing said liquid in said container when water level in said water tank drops below a predetermined level, and a mounting unit for mounting said container on a rim of said water tank, wherein the improvement comprises:

said mounting unit including an elongated first support member mounted slidably on a top surface of said container, and an elongated second support member mounted slidably and longitudinally to said first support member, said second support member having one end portion formed with a hook portion, and another end portion connected slidably to said first support member, said first support member having a distal end adjacent to said hook portion of said second support member, said hook portion of said second support member being movable relative to said distal end of said first support member so as to define a variable holding space with said distal end of said first support member for engaging said rim of said water tank, said first support member being movable relative to said container to permit maintaining of said container at an upright position so as to ensure proper operation of said float-controlled valve assembly.

2. A liquid releasing device as claimed in claim 1, wherein said first support member includes a sleeve member which has two opposite side walls, a base wall interconnecting said side walls for confining a guiding groove among said base and side walls, and two aligned resilient retaining tongues mounted respectively to inner faces of said side walls, said another end portion of said second support member being formed with an elongated slide piece which is received fittingly and slidably within said guiding groove of said sleeve member and which has two opposite side surfaces formed respectively with a plurality of teeth that are engageable with said retaining tongues of said sleeve member so as to position adjustably said slide piece in said guiding groove.

3. A liquid releasing device as claimed in claim 2, wherein said container has a dovetail groove which is formed in said top surface thereof and which opens in two opposite side surfaces of said container, and two aligned retaining lugs which are secured respectively to two opposite inner side walls that confine said dovetail groove, said sleeve member being received slidably and fittingly within said dovetail groove and having a plurality of teeth formed on .outer faces of said side walls thereof, said retaining lugs being engageable with said teeth of said sleeve member so as to position adjustably said sleeve member in said dovetail groove.

* * * * *